United States Patent [19]

Aronson et al.

[11] 4,368,146

[45] Jan. 11, 1983

[54] LIGHT DUTY HAND DISHWASHING LIQUID DETERGENT COMPOSITION

[75] Inventors: Michael P. Aronson, Valley Cottage, N.Y.; Edilia A. Larrauri, West New York; Zahera J. Hussain, Wyckoff, both of N.J.

[73] Assignee: Lever Brothers Company, New York, N.Y.

[21] Appl. No.: 272,434

[22] Filed: Jun. 10, 1981

Related U.S. Application Data

[63] Continuation of Ser. No. 172,809, Jul. 28, 1980, abandoned, which is a continuation of Ser. No. 83,026, Oct. 9, 1979, abandoned, which is a continuation of Ser. No. 2,924, Jan. 12, 1979, abandoned.

[51] Int. Cl.[3] ..... C11D 1/83; C11D 3/28

[52] U.S. Cl. ..... 252/542; 252/544; 252/545; 252/547; 252/548; 252/551; 252/554; 252/555; 252/558; 252/DIG. 14

[58] Field of Search ..... 252/541, 542, 544, 545; 424/70, 80

[56] References Cited

U.S. PATENT DOCUMENTS

| | | | |
|---|---|---|---|
| 3,000,830 | 9/1961 | Fong et al. | 252/117 |
| 3,254,028 | 5/1966 | Wixon | 252/524 |
| 3,318,816 | 5/1967 | Trowbridge | 252/539 X |
| 3,393,154 | 7/1968 | Treitler | 252/541 |
| 3,689,435 | 9/1972 | Berni et al. | 252/524 |
| 3,749,682 | 7/1973 | Tanner | 252/524 |
| 3,932,295 | 1/1976 | Fujino et al. | 252/102 |
| 3,963,649 | 6/1976 | Spadini et al. | 252/546 |
| 3,970,594 | 7/1976 | Claybaugh | 252/524 |
| 3,979,339 | 9/1976 | Claybaugh | 252/524 |
| 3,980,769 | 9/1976 | Ghilardi et al. | 424/70 |
| 4,048,301 | 9/1977 | Papantoniou | 424/70 |
| 4,080,310 | 3/1978 | Ng et al. | 252/544 |
| 4,101,456 | 7/1978 | Renaud et al. | 252/551 |
| 4,144,201 | 3/1979 | Winterbotham et al. | 252/547 |

FOREIGN PATENT DOCUMENTS 7209130 1/1973 Netherlands .

*Primary Examiner*—P. E. Willis, Jr.

*Attorney, Agent, or Firm*—Irving N. Feit; James J. Farrell

[57] ABSTRACT

The present invention relates to light duty, hand dishwashing, liquid composition comprising (a) an anionic surface active agent, a nonionic surface active agent, or mixtures thereof; (b) a polyvinylpyrrolidone having a molecular weight equal to or greater than 40,000, a copolymer of N-vinylpyrrolidone and dimethylaminoethylmethacrylate having a molecular weight from about 40,000 to about 1,500,000, or mixtures thereof, and optionally, (c) an alkali metal salt of casein. The compositions according to the invention possess drainage modification characteristics that produce rapid and uniform drainage of rinse water from washed utensils and apparatus without the disadvantages of spotting and filming.

24 Claims, No Drawings

LIGHT DUTY HAND DISHWASHING LIQUID DETERGENT COMPOSITION

This is a continuation application of Ser. No. 172,809 filed July 28, 1980, which application is a continuation of Ser. No. 83,026 filed Oct. 9, 1979; which in turn is a continuation of Ser. No. 2,924, filed Jan. 12, 1979, all abandoned.

BACKGROUND OF THE INVENTION

As liquid dishwashing detergent formulations become increasingly popular with the consumer, the performance of such detergent compositions for cleaning kitchen utensils, such as glasses, dishes and other apparatus, becomes more important. Many performances characteristics are associated with this type of detergent formulation, among which are foamability, detergency, soil suspending ability, and mildness. In addition, the consumer has become concerned with both the final appearance of the objects that are washed and the ease with which washing, rinsing and the drying of the kitchen utensils can be accomplished.

Spotting may be referred to as resulting from the break-up of a once continuous liquid film followed by the isolation of liquid patches that become stranded on the solid surface. Upon the drying of these isolated liquid patches, spots will form from the solid residue that was dissolved or suspended in the liquid. One of the disadvantages associated with liquid dishwashing detergent compositions, therefore, is the need to dry the washed objects or apparatus with a towel so that spot and film formation from the minerals in the rinse water can be avoided or minimized to a large extent. Moreover, because of the amount of water that remains undrained on the glassware and plates and kitchen utensils, etc., the towel drying process tends to become time consuming and an additional burden to the consumer, thereby leaving it more desirable to let the washed utensils or apparatus drain and dry by themselves under ambient conditions.

Various attempts have been made to minimize the effect of the water hardness residue and film-forming deposits on washed kitchen utensils by applying various additives in the detergent formulations, either by complexing the water hardness salts, or by formulating special rinsing agents. However, the incorporation of complexing and/or soil suspending agents in the liquid formulations create processing and formulation problems, while any of the special rinsing agents that have been disclosed heretofore must be packed and applied separately in the washing solution.

One approach that has been utilized to reduce the need for towel drying and to increase the drainage of the washed kitchen utensils, has been to incorporate an agent into the formulation that can adsorb on the surface of the washed kitchen utensils to alter its wettability and surface properties, thereby modifying the drainage behavior of the rinsed water on the washed object. Under desirable conditions of wettability, the rinse water from the washed object will rapidly "sheet-off" the utensil, for example drinking glasses, thereby leaving the surface dry. This rapid "sheeting-off" effect reduces the effort involved in drying the washed objects and also improves their final appearance in terms of minimizing or altogether obviating the spotting and filming associated with suspended soil and water hardness.

Applicants have unexpectedly discovered that a liquid detergent composition containing a relatively small amount of polyvinylpyrrolidone or a copolymer of N-vinylpyrrolidone and dimethylamino-ethylmethacrylate, each having specific molecular weight limitations, and optionally, a small amount of an alkali metal salt of casein, e.g., sodium caseinate, when added to an anionic surfactant, nonionic surfactant, or mixtures thereof, provides an excellent washing and cleaning composition with much improved drainage properties so as to render the cleaned objects virtually free from spotting and/or filming.

THE PRIOR ART

Attempts have been made in overcoming the foregoing problems in the past and the following is a list of U.S. Pat. Nos. dealing with liquid dishwashing detergent formulations: 3,928,249, issued Dec. 23, 1975; 3,963,649, issued June 15, 1976; 3,548,056, issued Dec. 15, 1970; 3,749,682, issued July 31, 1973; 3,689,435, issued Sept. 15, 1972; 3,318,816, issued May 9, 1967; 3,254,028, issued May 31, 1966; 3,000,830, issued Sept. 1961; 3,898,186, issued Aug. 5, 1975; 3,963,649, issued June 5, 1976; and 3,983,079, issued Sept. 28, 1976.

The following U.S. Pat. Nos. disclose the use of polyvinylpyrrolidone in detergent formulations as an anti-redeposition agent: 3,000,830, issued Sept. 19, 1961; 3,254,028, issued May 31, 1966; 3,318,816, issued May 9, 1967; 3,689,435, issued Sept. 5, 1972; 3,749,682, issued July 31, 1973; 3,839,214, issued Oct. 1, 1974; and 3,932,295, issued Jan. 13, 1976.

The following U.S. Pat. Nos. deal with light duty liquids generally, but do not disclose the use of polyvinylpyrrolidone or copolymer of N-vinylpyrrolidone and dimethylamino-ethylmethacrylate in the compositions: 2,941,950, issued June 21, 1960; 2,941,951, issued June 21, 1960; 3,468,805, issued Sept. 23, 1969; 3,547,932, issued Dec. 15, 1970; 3,574,125, issued Apr. 6, 1971; 3,649,543, issued Mar. 14, 1972; 3,679,611, issued July 25, 1972; 3,755,206, issued Aug. 28, 1973; 3,775,349, issued Nov. 27, 1973; 3,793,233, issued Feb. 19, 1974; 3,808,156, issued Apr. 30, 1974; 3,936,317, issued Feb. 3, 1976; 3,944,663, issued Mar. 16, 1976; 3,963,635, issued June 15, 1976.

The above patent disclosures are not within the scope of the present invention with regard to the combined ingredients contained therein or the benefit provided thereby.

SUMMARY OF THE INVENTION

This invention pertains to a light duty, hand dishwashing, liquid detergent composition comprising:

1. About 2% to about 50% by weight of an anionic surfactant compound, nonionic surfactant compound, or mixtures thereof;
2. About 0.1% to about 10% by weight of a polyvinylpyrrolidone having a molecular weight equal to or greater than 40,000, a copolymer of N-vinylpyrrolidone and dimethylamino-ethylmethacrylate having a molecular weight from about 40,000 to about 1,500,000, or mixtures thereof; and optionally,
3. From 0% to about 5% by weight of an alkali metal salt of casein, preferably from about 0.5% to about 5% by weight; the percentages expressed being based on the total weight of the composition.

The above liquid detergent composition provides excellent drainage of washed kitchen utensils and apparatus, and prevents water spotting and filming when the utensils are left to dry. Moreover, the utensils are left with a shiny clean appearance and eliminate the necessity for towel drying or wiping.

DETAILED DESCRIPTION OF THE INVENTION

The liquid detergent composition will generally contain from about 5% to about 50% by weight, preferably from about 10% to about 30% by weight of the total composition of an anionic surfactant compound.

Among the suitable synthetic anionic surface active agents that may be present in the liquid dishwashing detergent composition are the water-soluble hydrocarbon sulfates having the general formula:

$$R_1O(C_2H_4O)_nSO_3M$$

wherein $R_1$ is a straight or branched, saturated or unsaturated, aliphatic hydrocarbon radical having from 8 to 22 carbon atoms; n is from 0 to about 15; and M is a cation, preferably sodium, potassium or ammonium. Important examples which form part of the preferred composition of the present invention are the salts of an organic, sulfuric acid reaction product of a saturated or unsaturated fatty alcohol having 8 to 18 carbon atoms, preferably tallow or coconut alcohol, reacted with 1.5 to 15, preferably 3 to 13 moles of ethylene oxide per mole of fatty alcohol. Specific examples are $C_{12-14}$ alkyl—O—$(C_2H_4O)_3$—$SO_3Na$; $C_{14}$ alkyl—O $(C_2H_4O)_3$-$SO_3NH_4$; $C_{12-16}$ alkyl—O—$(C_2H_4O)_6$—$SO_3K$; and tallow—O—$(C_2H_4O)_9$—$SO_3N(H)_2$ $(C_2H_4OH)_2$. Important examples of hydrocarbon sulfates as represented by the above formula whereby n is 0, are those obtained by sulfating hydroxylated hydrocarbons, preferably fatty alcohols having 8 to 18, most preferably 12 to 16 carbon atoms, with $SO_3$, $H_2SO_4$, etc., followed by hydrolysis and/or bleaching according to processes well known in the art.

Also suitable are the water-soluble salts of the organic sulfuric acid reaction products of the general formula:

$$R_2—SO_3M$$

wherein $R_2$ is chosen from the group consisting of a straight or branched, saturated or unsaturated, aliphatic hydrocarbon radical having from 8 to 24, preferably from 12 to 18 carbon atoms; and an alkylbenzene radical having from 8 to 18, preferably from 12 to 16 carbon atoms in the alkyl group; and M is a cation, preferably sodium, potassium, ammonium, magnesium or calcium. Important examples of the synthetic detergents which form a part of the preferred compositions of the present invention are the salts of an organic, sulfuric acid reaction product of a hydrocarbon of the methane series, incuding iso-, neo-, meso-, and n-paraffins, having 8 to 24 carbon atoms, preferably 11 to 18 carbon atoms, and 1 up to 4 double bonds, and a sulfonating agent, e.g., $SO_3$, $H_2SO_4$, oleum, obtained according to known sulfonation methods, including bleaching and hydrolysis. Preferred are sulfonated $C_{12-18}$ n-paraffins, alone or in combination with sulfonated alpha olefins containing an average of 14 carbon atoms. Important examples of alkylbenzene sulfonates in which the alkyl group contains from about 9 to about 18 carbon atoms are dodecyl-, tetradecyl-, and hexadecylbenzene sulfonates and those which are described in U.S. Pat. Nos. 2,220,099 and 2,477,383.

The preferred anionic surface-active agent which can be included in the composition of the present invention, is the water-soluble hydrocarbon sulfate as represented hereinbefore by the general formula $R_1O(C_2H_4O)_n$-$SO_3M$, wherein $R_1$ is preferably a straight, saturated, aliphatic hydrocarbon radical, having from 8 to 20, desirably 12 to 16 carbon atoms; n is preferably from 3 to 9; and M is preferably sodium, potassium or ammonium. Said preferred ethoxylated hydrocarbon sulfates can be present in amounts up to 50%, but are preferably present between 5 and 35% by weight, based on the total weight of the composition.

In case of combinations of water-soluble, ethoxylated hydrocarbon sulfates, as represented by the aforementioned general formula $R_1O(C_2H_4O)_nSO_3M$, and water-soluble salts of the organic, sulfuric acid reaction product of the general formula $R_2SO_3M$, wherein $R_1$, $R_2$, and M and n have the same meaning recited above; the weight ratio of said water-soluble salts of the organic, sulfuric acid reaction product to the ethoxylated hydrocarbon sulfate will usually be, dependent upon the concentration and type of the metal cations present in the wash solution (i.e., the ionic strength) from about 10:1 to about 1:10, preferably from about 3:1 to about 1:1. The most preferred are those compositions whereby the water-soluble ethoxylated hydrocarbon sulfates are $C_{12-16}$ alkyl—O—$(C_2H_4O)_{3-6}SO_3M$, and the water-soluble salts of the organic, sulfuric acid reaction products are $C_{11-18}$ paraffin sulfonates.

The levels of nonionic surface-active detergent in the liquid detergent composition of the present invention will preferably be from about 1% to about 30% by weight, most preferably from about 1% to about 10% by weight based on the total weight of the composition.

Suitable, water-soluble, nonionic surface-active agents to be used in the formulation of the liquid dishwashing detergent composition of the present invention are the water-soluble, nonionic, tertiary amine oxides as represented hereinafter by the general formula:

$$R_3R_4R_5N—O$$

whereby $R_3$ represents a high molecular, straight or branched, saturated or unsaturated, aliphatic hydrocarbon, hydroxyhydrocarbon, or alkyloxyhydrocarbon radical, preferably an alky radical having a total of 8 to 24, preferably 12 to 18; $R_4$ and $R_5$, which may be the same or different, represent each a methyl, ethyl, hydroxymethyl, and hydroxyethyl radical.

They are generally prepared by direct oxidation of appropriate tertiary amines according to known methods. Specific examples of tertiary amine oxides are: dimethyl dodecyl amine oxide, diethyl tetradecyl amine oxide, bis-(2-hydroxyethyl)-docecyl amine oxide, bis-(2-hydroxyethyl)-3-dodecoxy-1-hydroxypropyl amine oxide, dimethyl 2-hydroxydodecyl amine oxide, and diethyl eicosyl amine oxide.

Another group of suitable nonionic surfactant compounds are the water-soluble, tertiary phosphine oxides, represented by the general formula:

$$R_3R_4R_5P—O$$

whereby $R_3$, $R_4$ and $R_5$ have the same meaning as described hereinbefore. They can be prepared by alkylating an alkyl phosphine derivative and oxidizing the resulting reaction product. Specific examples of tertiary phosphine oxides are: dimethyl dodecyl phosphine oxide, diethyl tetradecyl phosphine oxide, bis-(2-hydroxyethyl)-dodecyl phosphine oxide, tetradecyl ethyl 2-hydroxyethyl phosphine oxide, oleyl dimethyl phosphine oxide, and 2-hydroxydodecyl dimethyl phosphine oxide.

Still another group of nonionic surfactant compounds are the water-soluble amides represented by the general formula:

$$R_6—CO—N(H)_{m-1}(R_7OH)_{3-m}$$

wherein $R_6$ is a saturated or unsaturated, aliphatic hydrocarbon radical having from 7 to 21, preferably from 11 to 17, carbon atoms; $R_7$ represents a methylene or ethylene group; and m is 1, 2 or 3, preferably 1. Specific examples of said amides are mono-ethanol coconut fatty acid amide, diethanol dodecyl fatty acid amide and dimethanol oleyl amide.

Yet another group of nonionic surfactant compounds are the water-soluble condensation products obtained by condensing from 3 to about 25 moles of an alkylene oxide, preferably ethylene or propylene oxide, with one mole of an organic hydrophobic compound, aliphatic or alkyl aromatic in nature and having 8 to 24 carbon atoms and at least one reactive hydrogen atom, preferably a reactive hydroxyl, amino, amido, or carboxy group. Specific examples of these groups of compounds are:

1. condensation products of ethylene oxide with aliphatic alcohols of more than 8 carbon atoms. The alcohols are usually derived from the naturally occurring fatty acids or from various branched-chain higher alcohols. Among the preferred alcohol-ethylene oxide condensation products are those made from alcohols derived from tallow and coconut fatty acids. Most preferred are the condensation products of about 4 to about 12 moles of ethylene oxide per mole of an aliphatic alcohol having from about 10 to about 18 carbon atoms, in particular a middle-cut coconut fatty alcohol condensed with 6 moles of ethylene oxide;
2. condensation products of ethylene oxide with alkylphenols, whereby the phenols may be mono- or polyalkylated and the total number of sidechain carbon atoms may be from 5 to 18 carbon atoms. The aromatic nucleus bearing the phenolic hydroxyl may be benzene, naphthalene, or diphenyl, preferably benzene. Specific examples are condensation products of one mole of nonylphenol with 9 to 15 moles of ethylene oxide;
3. condensation products of ethylene oxide with the fatty acid esters, preferably mono-fatty acid esters of the sugar alcohols, sorbitol and manitol, and also of di- and polysaccharides. Specific examples of the polyoxyethylene sorbitan-monolauric acid esters having 20 or more ethylene oxide units; and the polyoxyethylene derivatives of fatty acid partial esters of hexitol anhydrides generally known under the trade name TWEEN, available from ICI America, Inc., Wilmington, Del.;
4. polyethenoxy esters, or esters formed by reaching ethylene oxide with carboxylic acids. The acids can be natural fatty acids or fatty acids made from oxidized paraffin wax, or mono- or alkylated benzoic and naphthenic acids. Desirable are aliphatic fatty acids having from 10 to 20 carbon atoms, and benzoic acids with 5 to 18 carbon atoms in the alkyl groups. Specific examples and preferred condensation products are tall oil ethylene oxide condensation products having 9 to 15 ethylene oxide units;
5. condensation products of fatty acyl alkanolamides of the type $C_{7-17}$ alkyl—CO—$NHC_2H_4OH$, $C_{7-17}$ alkyl—CO—N—$(C_2H_4OH)_2$ with ethylene oxide. Those preferred are condensation products of one mole of coconut —CO—NH—$C_2H_4OH$ with 5 to 20 moles of ethylene oxide Specific examples of polyethenoxy alkanolamides of fatty acids are the commercial products, marketed under the trade name ETHOMID, available from Armak Chemical Company, Chicago, Illinois.
6. condensation products of $C_{8-18}$ alkyl-, $C_{8-18}$ alkenyl- and $C_{5-18}$ alkylaryl amines and ethylene oxide. A specific and preferred example is the condensation product of one mole of dodecylamine with 9–12 moles of ethylene oxide.

The maximum level of water-soluble, anionic and nonionic surface-active agents that can be included in the liquid detergent composition of the present invention will usually depend on the level of each of the surfactants present and also to a certain extent on the presence of the drainage modification agents herein. The maximum amount of both nonionic and anionic surface-active agents which can be present in the composition of the present invention is about 50% by weight based on the total weight of the composition.

The polyvinylpyrrolidone, according to the invention, has a molecular weight equal to or greater than 40,000, preferably in the range of from about 50,000 to about 500,000. The polyvinylpyrrolidones are polymers of N-vinyl pyrrolidone, the monomer of which has the following structure:

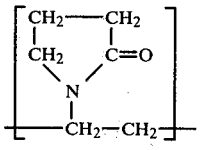

The polyvinylpyrrolidone is present in the composition from about 0.1% to about 10% by weight of the total composition, preferably from about 0.5% to about 3.0% by weight.

Examples of polyvinylpyrrolidone that are commercially available are those sold by the GAF Corporation and marketed under the trade name PVP-K90, which has a molecular weight of 360,000, and PVP-K30, which has a molecular weight of 40,000.

Another ingredient that may be useful in the present liquid dishwashing detergent composition to provide enhanced drainage properties, is a copolymer of N-vinyl pyrrolidone and dimethylamino-ethylmethacrylate whose monomer structure is represented by the following formula:

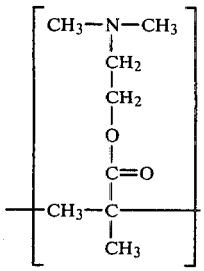

The molecular weight of this copolymer is preferably between 40,000 and 1.5 million, and may be present in the composition from about 0.1% to about 10% by weight of the total composition, preferably between 0.5% and 3.0% by weight. A copolymer that is commercially available may be obtained from the GAF Corporation under the trade name of Gafquat 755, having a molecular weight of about 1 million, and Gafquat 734 having a molecular weight of about 100,000.

The polyvinylpyrrolidone and copolymer drainage modification agents may be used either alone or in combination with each in amounts to obtain the maximum benefit of the drainage properties without affecting the detergency of the dishwashing liquid composition. This will depend to a great extent on the specific surfactant system being used.

An optional ingredient that may be used in the dishwashing liquid composition is an alkali metal salt of the protein, casein, preferably sodium caseinate. The caseinate can be present in the composition in an amount of from 0.5% to about 5% by weight based on the total weight of the composition, preferably from 1.0% to about 3.0% by weight. A commercial grade of sodium caseinate is available from Western Dairy Products under the trade name of Savortone LF having the following analysis:

| | % Dry Weight |
|---|---|
| Protein | 95% |
| Fat | 1.2% |
| Ash | 4.0% |
| Moisture | 4.0% |
| pH (5% aqueous solution) | 6.7 |

A more adequate description of casein and its salts may be found in the "Fundamentals of Dairy Chemistry" by B. H. Webb, A. H. Johnson, and J. A. Alford, Avi Publication Co., Inc., 2d Ed. (1974), pp. 92–111, which is incorporated herein by reference.

A preferred embodiment for the dishwashing liquid detergent composition according to the invention is one which contains (a) from about 10% to about 50% of an anionic surfactant compound, or a mixture of anionic surfactant compounds; (b) from about 1% to about 10% of a nonionic surfactant compound, or a mixture of nonionic surfactant compounds; (c) from about 0.5% to about 3.0% of a polyvinylpyrrolidone having a molecular weight equal to or greater than 40,000, or a copolymer of N-vinylpyrrolidone and dimethylamino-ethylmethacrylate having a molecular weight between about 40,000 and 1.5 million, or mixtures thereof; and (d) from about 1.0% to about 3.0% of sodium caseinate; the percentages expressed being based on the total weight of the composition.

Additional ingredients that can be optionally included in the hand dishwashing liquid composition of the present invention are water-soluble, low molecular weight organic acid, or the water-soluble alkali metal, ammonium, or substituted ammonium salts thereof. Organic acids or their salts are added to enhance the cleaning action of the liquid detergent composition of the present invention and can, in addition, be used as a source of ions to maintain the pH of the composition at a given pH value. Suitable water-soluble, low molecular weight organic acids include, for example, acetic, citric, malic, gluconic, maleic, lactic, tartaric, propionic, butyric, malonic, polymaleic, polyitaconic, glutaric, citraconic, benzene pentacarboxylic, hexacarboxylic, succinic, ethylene diamine tetra-acetic, and nitrilotriacetic acids. Partially and completely neutralized salts of the foregoing acids can also be used. Specific examples of suitable, organic acid salts are mono-, di- and trisodium citrate, diammonium citrate, monopotassium tartrate, disodium succinate, and tetrasodium melletate.

The maximum level of the water-soluble organic acids or salts that can be added to the liquid detergent composition of the present invention should usually not exceed 15 percent by weight of the total weight of the composition, and should preferably be below about 10 percent by weight. Some of the organic acid salts can be replaced by inorganic builder salts. The amount of inorganic builder salts, e.g. sodium phosphates and carbonates, should preferably not exceed 5 percent by weight in the composition.

Other suitable ingredients or additional compounds that can optionally be added to improve consumer acceptance of the composition of the present invention are: perfume; dyes; fluroescers; tarnish inhibitors, such as benzotriozole or ethylene thio-urea; shine improvers, such as boric acid or its salts in amounts of up to 3 percent by weight; bactercides such as 2-bromo-2-nitro-1, 3-propanediol, substituted benziodolium compounds, diphenyl ethers substituted with Cl, Br or —$CF_3$, e.g., 3,4-dichloro-4'-trifluoromethyldiphenyl ether; organic solvents; and hydrotropes; in amounts of up to about 15 percent by weight to improve the pourability of the composition and to enhance the compatibility of the different components. Examples of the organic solvents are the mono- and dialcohols containing 2 to 8 carbon atoms such as ethanol, butanol, methylpropanol-1 and -2, amylol (pentanol), 1,2- 1,3- and 1,4-butanediol, toluol, benzyl carbinol, ethyleneglycol monobutyl ether, propyleneglycol propyl either and diethyleneglycol dimethyl ether. Examples of hydrotropes are sodium, potassium or ammonium xylene sulfonate, and sodium, potassium or ammonium isethionate.

The benefits and advantages of the instant liquid dishwashing detergent composition are illustrated in the examples and tests set forth below.

EXAMPLE 1

The substrates used to judge the effectiveness of the foregoing agents in the drainage modification in a liquid dishwashing detergent composition of all of the examples herein were either 10 ounce drinking glasses (Libby 10 ounce collins tumblers), glass dinner plates (9-inch diameter), ceramic dinner plates (9-inch diameter), or plastic dinner plates (9-inch diameter), Boontonware. The substrates were washed with various detergent compositions at a use level of 0.15% and 0.20% for 1 minute and 3 minutes at a temperature of 40°–45° C. Edgewater, N.J. tap water was used in all of the experiments. The substrates were then rinsed either under running tap water or in a dishpan filled with clean tap water. In both cases, the temperature of the rinse water was approximately 45° C. The duration of the rinse was varied between 10 seconds and 2 minutes.

After the rinse, the substrate was placed on a rack to dry. The time at which drainage began and the percentage of the surface area of the substrate that dried due to this drainage were recorded. The degree of benefit arising from the agent is directly related to the time at which drainage begins and the percentage of the area dried by this drainage. The benefit produced by drainage modification increases with increasing drainage rate and increasing percentage area dried by the enhanced drainage, provided that the rinse water film drains as a uniform sheet, and does not break up into water droplets which produce objectionable spotting.

The drainage agents used in the following tests are listed in Table 1 below.

TABLE 1

| Drainage Modification Agent | Composition |
|---|---|
| PVP-K90* | Polyvinylpyrrolidone, MW ≅ 360,000 |
| PVP-K30* | Polyvinylpyrrolidone, MW ≅ 40,000 |
| Gafquat 755* | Copolymer of N—vinylpyrrolidone and dimethylamino-ethylmethacrylate MW ≅ 1,000,000 |
| Gafquat 734* | Copolymer of N—vinylpyrrolidone and methylamino-ethylmethacrylate MW ≅ 100,000 |
| Gelatin** | Type B, Bloom strength-225 |
| Savortone LF*** | Sodium Caseinate |

*Available from the GAF Corporation.
**Available from General Foods, Inc.; also described in U.S. Pat. No. 3,963,649.
***Available from Westerm Dairy Products.

The influence of polyvinylpyrrolidone and the copolymer of N-vinylpyrrolidone and dimethylamino-ethylmethacrylate on the drainage of rinse water from several substrates after washing with a liquid dishwashing composition is set forth in Table 3. The surfactant system used in these formulations is given in Table 2 below:

TABLE 2

| Surfactant System | % Weight |
|---|---|
| Secondary alkane ($C_{15.3}$ avg.) sulfonate (SAS-60)**** | 17% |
| Ammonium $C_{12}$–$C_{15}$ (3 ethylene oxide) sulfate | 12% |
| Lauryl diethanolamide | 5% |
| Ethanol | 5% |
| Water | too 100% |

All of the results shown in Table 3 are compared with the base surfactant system given in Table 2 without the inclusion of a drainage modification agent.

TABLE 3

Effect of Drainage Modification Agents on Substrates.

| Agent | Concentration in Formulation | Time for Effect To Begin (seconds) | | | % Area Dried By Evaporation | | |
|---|---|---|---|---|---|---|---|
| | | Glasses | Glass Plates | Plastic Plates | Glasses | Glass Plates | Plastic Plates |
| No agent | — | — | — | — | 100 | 100 | 100 |
| PVP K-90 | 10% | 9 | — | — | <10 | — | — |
| PVP K-90 | 5% | 4 | 5 | 10 | 30 | 25 | 25 |
| PVP K-90 | 2% | 10 | — | — | 10–15 | — | — |
| PVP K-90 | 1% | 12 | — | — | 20 | — | — |
| PVP K-30 | 10% | 10 | — | — | 20–30 | — | — |
| Gafquat-755 | 10% | 8 | — | — | 10–20 | — | — |
| Gafquat-734 | 10% | 4 | — | — | <10 | — | — |
| Gafquat-734 | 5% | 3 | 3 | 10 | <10 | 10 | 25 |
| Gafquat-734 | 2.5% | — | 3 | 3 | — | 23 | 70 |
| Gafquat-734 | 2.0% | 10 | — | — | 15 | — | — |
| Gafquat-734 | 1.0% | 15 | — | — | 30 | — | — |
| Gafquat-734 | 0.35% | 12 | — | — | 50 | — | — |
| Gafquat-734 | 0.21% | 10 | — | — | 55 | — | — |
| Na Caseinate | 2.5% | 12 | 3 | 4 | 70 | 75 | 76 |
| Na Caseinate | 2.0% | 20 | — | — | 85 | — | — |
| Na Caseinate | 1.0% | — | — | — | 100 | — | — |
| Gelatin** | 2.0% | 10 | — | — | 85 | — | — |
| Gelatin** | 1.0% | 12 | — | — | 85 | — | — |

EXAMPLE 2

The effect of using different surfactant systems with the drainage modification agents polyvinylpyrrolidone and copolymer of N-vinylpyrrolidone and dimethylamino-ethylmethacrylate is set forth in Table 5. Various surfactant systems were tested with these drainage modification agents. The compositions of the formulations are described in Table 4. The percentages expressed are based on the total weight of the composition.

TABLE 4

| Component | 1 | 2 | 3 | 4 |
|---|---|---|---|---|
| Ammonium Linear alkyl ($C_{13}$) benzene sulfonate | — | 17% | — | — |
| Secondary alkane ($C_{15.3}$ avg.) sulfonate (SAS-60)**** | 17% | — | — | 17% |
| Sodium Lauryl Sulfate | — | — | 17% | — |
| Ammonium $C_{12-15}$ (3 Ethylene oxide) sulfate | 12% | 12% | 12% | 12% |
| Lauryl diethanolamide | 5% | 5% | 5% | — |
| Lauryl dimethyl amine oxide | — | — | — | 5% |
| Ethanol | 5% | 5% | 5% | 5% |
| Water | | to 100 | | |

Each of the drainage modification agents in the liquid detergent compositions of Table 4 were compared with a surfactant system having no agent included therein. Table 5 shows the results of drainage tests performed on drinking glass substrates with the surfactant systems of Table 4.

TABLE 5

| Drainage Modification Agent | Wt. % in Formulation | Time for Effect To Begin (sec.) -Formulation # 1 | 2 | 3 | 4 | % Area Dried By Evaporation Formulation 1 | 2 | 3 | 4 |
|---|---|---|---|---|---|---|---|---|---|
| No agent | — | — | — | — | — | 100 | 100 | 100 | 100 |
| PVP K-90 | 10% | 10 | 5 | 10 | — | 10 | 15 | 10 | — |
| PVP K-90 | 2% | 12 | 13 | — | 10 | 50 | 80 | — | 60 |
| PVP K-30 | 10% | 10 | 10 | 10 | — | 25 | 20 | 20 | — |
| Gafquat-755 | 10% | 10 | 8 | 10 | — | 10 | 10 | 10 | — |
| Gafquat-734 | 10% | 5 | 4 | 10 | — | 10 | 15 | 15 | — |
| Gafquat-734 | 2% | 14 | 11 | 20 | 12 | 45 | 75 | 75 | 20 |

Influence of Surfactant Systems on Drainage Modification of Drinking Glasses

EXAMPLE 3

Mixtures of polyvinylpyrrolidone and the copolymer of the present invention with sodium caseinate shows enhanced drainage modification on various substrates as compared with sodium caseinate used alone. This is demonstrated by the results shown in Table 6 with a surfactant system used according to Example 1.

TABLE 6

Drainage Modification Produced By Combinations of Copolymer and Sodium Caseinate

| Agent | Wt. % in Formulation | Ceramic Plates Time(sec), | Ceramic Plates % Area | Plastic Plates Time(sec), | Plastic Plates % Area | Glass Plates Time(sec), | Glass Plates % Area |
|---|---|---|---|---|---|---|---|
| Na Caseinate | 2.5% | — | 100 | 3 | 76 | 3 | 75 |
| Gafquat-734 | 2.5% | 4 | 40 | 3 | 70 | 3 | 23 |
| Na Caseinate plus Gafquat-734 | 2.5% 2.5% | 2 | 2.5 | 3 | 73 | 2.5 | 1 |
| Gafquat-734 | 5.0% | — | — | 10 | 25 | 3 | 1 |

It will be seen that the sodium caseinate used alone is not as effective as when it is used in combination with the drainage modification agents according to the invention herein.

EXAMPLE 4

The influence of soil on the surfactant system according to Example 1 utilizing the copolymer of N-vinylpyrrolidone and dimethylamino-ethylmethacrylate is shown in Table 7.

TABLE 7

Influence of Soil on Drainage Modification

| Agent | Substrate | Soil | Time For Effect To Begin (sec.) | % Area Dried By Evaporation |
|---|---|---|---|---|
| No agent | Glasses | — | no effect | 100 |
| No agent | Glasses | Milk | no effect | 100 |
| Gafquat-734, 5% by weight | Glasses | — | 3 | 10 |
| Gafquat-734, 5% by weight | Glasses | Milk | 5 | 10 |
| No agent | Glass plates | — | no effect | 100 |
| No agent | Glass plates | Gravy | no effect | 100 |
| Gafquat-734, 5% by weight | Glass plates | — | 3 | 10 |
| Gafquat-734, 5% by weight | Glass plates | Gravy | 5 | 10 |
| No agent | Plastic plates | — | no effect | 100 |
| No agent | Plastic plates | Bacon Fat | no effect | 100 |
| Gafquat-734, 5% by weight | Plastic plates | — | 10 | 25 |
| Gafquat-734, 5% by weight | Plastic plates | Bacon fat | 5 | 10 |

TABLE 7-continued

Influence of Soil on Drainage Modification

As can be seen from the results shown in Table 7, the impact of a variety of soils does not have any significant effect on drainage produced by the drainage modification agents in a surfactant system according to the present invention.

EXAMPLE 5

The results described thus far in the foregoing tables have concerned the extent to which drainage modification agents according to the invention decrease the surface area that dries by evaporation for a given substrate, e.g., glassware. This rapid drainage not only facilitates the drying process but also significantly improves the final appearance of the glassware with respect to liquid dishwashing formulations. The following test illustrates the extent of this improvement in appearance.

Ten drinking glasses were soiled with milk. Five of the glasses were washed in a formulation containing 2.5% by weight of Gafquat-734 copolymer and 2.5% by weight of sodium caseinate in combination with Surfactant Formulation Number 1 described in Table 4. The remaining five glasses were washed in a solution of a commercial hand dishwashing liquid composition at an identical concentration of 0.20%. The commercial liquid composition is set forth below in Table 8. A panel of 12 people then compared the two sets of glasses with respect to spotting, filming and general appearance under normal laboratory lighting. The panel unanimously selected glasses washed in the copolymer Gafquat 734/sodium caseinate formulation as having less spotting and filming and as having an overall "cleaner" appearance compared with the glasses washed with the commercial product.

TABLE 8

| Component | Percent Weight |
|---|---|
| Ammonium fatty ($C_{12-14}$) alcohol (3 E.O.) sulfate | 25.0% |
| Potassium alkyl ($C_{12-14}$) oxyhydroxypropane sulfonate | 3.8% |
| Dimethyl alkyl amine oxide | 6.0% |
| Ethanol | 5.6% |
| Nonionic by-product ($C_{12-14}$ fatty alcohol + $C_{12-14}$ fatty alcohol (3 E.O.) ethoxylate) | 2.5% |
| KCl | 2.5% |
| NaCl | 0.9% |
| $K_2SO_4$ | 0.2% |
| Water | to 100 |

What is claimed is:

1. A method for cleaning kitchen utensils comprising treating said utensils with a liquid detergent composition containing:

(a) from about 1% to about 50% by weight of an anionic surfactant compound, nonionic surfactant compound, or mixtures thereof;

(b) from about 0.1% to about 10% by weight of a polyvinylpyrrolidone having a molecular weight equal to or greater than 40,000, a copolymer of N-vinylpyrrolidone and dimethylaminoethyl methacrylate having a molecular weight from about 40,000 to about 1,500,000, or mixtures thereof; and (c) from 0 to about 5% by weight of an alkali metal salt of casein.

2. The method according to claim 1 wherein component (c) is present in an amount of from 0.5 to about 5% by weight of the total composition.

3. The method of claim 2 wherein component (c) is sodium caseinate.

4. The method of claim 1 wherein component (b) is a polyvinylpyrrolidone having a molecular weight equal to or greater than 40,000.

5. The method of claim 1 wherein component (b) is a copolymer of N-vinylpyrrolidone and dimethylaminoethyl methacrylate having a molecular weight of from about 40,000 to about 1,500,000.

6. The method of claim 1 wherein the anionic surfactant is a water-soluble hydrocarbon sulfate having the formula $R_1O(C_2H_4O)_nSO_3M$ wherein $R_1$ is a straight or branched, saturated or unsaturated, aliphatic hydrocarbon radical having from 8 to 22 carbon atoms; n is an integer from 0 to about 15; and M is a cation of sodium, potassium or ammonium.

7. The method of claim 6 wherein $R_1$ is an alkyl group having 12 to 14 carbon atoms and n is an integer from 2 to 5.

8. The method of claim 7 wherein M is ammonium.

9. The method of claim 1 wherein the anionic surfactant is a compound of the formula $$R_2—SO_3M$$

wherein $R_2$ is a straight or branched, saturated or unsaturated, aliphatic hydrocarbon radical having from 8 to 24 carbon atoms, or an alkyl benzene radical having from 8 to 18 carbon atoms in the alkyl group; and M is a cation.

10. The method of claim 9 wherein $R_2$ is a straight or branched, saturated or unsaturated, aliphatic hydrocarbon radical having from 11 to 18 carbon atoms.

11. The method of claim 9 wherein $R_2$ is an alkyl benzene radical having from 11 to 16 carbon atoms in the alkyl group.

12. The method of claim 9 wherein M is sodium, potassium, ammonium, magnesium or calcium.

13. The method of claim 12 wherein M is ammonium.

14. The method of claim 9 wherein $R_2$ is an alkyl benzene radical having from 11 to 18 carbon atoms, and M is ammonium.

15. The method of claim 1 wherein the nonionic surfactant is a water-soluble tertiary amine oxide having the general formula $$R_3R_4R_5N—O$$

wherein $R_3$ represents a high molecular straight or branched, saturated or unsaturated, aliphatic hydrocarbon, hydroxyhydrocarbon, or alkyloxyhydrocarbon radical, having a total of 8 to 24 carbon atoms, and $R_4$ and $R_5$, which may be the same or different, represent each a methyl, ethyl, hydroxymethyl or hydroxyethyl radical.

16. The method of claim 1 wherein the nonionic surfactant is a comound of the formula $$R_3R_4R_5P—O$$

wherein $R_3$ represents a high molecular, straight or branched, saturated or unsaturated, aliphatic hydrocarbon, hydroxyhydrocarbon, or alkyloxyhydrocarbon radical, having a total of from about 8 to about 24 carbon atoms; and $R_4$ and $R_5$, which may be the same or different, represent each a methyl, ethyl, hydroxymethyl or hydroxyethyl radical.

17. The method of claim 1 wherein the nonionic surfactant is a comound of the formula $$R_6—CO—N(H)_{m-1}(R_7OH)_{3-m}$$

wherein $R_6$ is a saturated or unsaturated, aliphatic hydrocarbon radical having from about 7 to about 21 carbon atoms; $R_7$ is a methylene or ethylene group; and m is an integer from 1 to 3.

18. The method of claim 17 wherein $R_6$ has about 11 to about 17 carbon atoms, $R_7$ is a ethylene group, and m is an integer of 1.

19. The method of claim 17 wherein the nonionic surfactant is lauryl diethanolamide.

20. The method of claim 1 wherein the nonionic surfactant is a water-soluble condensation product of from about 3 to about 25 moles of an alkylene oxide and 1 mole of an organic, hydrophobic aliphatic or alkyl compound having at least one reactive hydrogen atom.

21. The method of claim 1 wherein the nonoinic surfactant is a water-soluble condensation product of ethylene oxide with (a) an aliphatic alcohol having from about 10 to about 18 carbon atoms; (b) an alkylphenol; (c) a fatty acid ester; (d) a polyethenoxy ester or an ester formed by reacting ethylene oxide with a carboxylic acid; (e) a fatty acyl alkanolamide; or (f) a $C_{8-18}$ alkyl-, $C_{8-18}$ alkenyl-, or $C_{5-8}$ alkylaryl amine.

22. A method for cleaning kitchen utensils comprising treating said utensils with a composition containing:

(a) from about 10% to about 30% of an anionic surfactant compound, or a mixture of anionic surfactant compounds;

(b) from about 1% to about 10% of a nonionic surfactant compound, or mixture of nonionic surfactant compounds;

(c) from about 0.5% to about 3.0% of a polyvinylpyrrolidone having a molecular weight equal to or greater than 40,000, a copolymer of N-vinylpyrrolidone and dimethylaminoethyl methacrylate having a molecular weight between about 40,000 and 1.5 million, or mixtures thereof; and (d) from about 1.0% to about 3.0% of sodium caseinate; the percentages expressed being based on the total weight of the composition.

23. The method of claim 22 wherein component (c) is a polyvinylpyrrolidone having a molecular weight from about 50,000 to about 500,000.

24. The method of claim 22 wherein component (c) is the copolymer of N-vinylpyrrolidone and dimethylaminoethyl methacrylate.

* * * * *